United States Patent [19]

Varney

[11] Patent Number: 4,915,091

[45] Date of Patent: Apr. 10, 1990

[54] HIGH EFFICIENCY COMBUSTION HEATER

[76] Inventor: J. Arnold Varney, 7326 Ogelsby Ave., Los Angeles, Calif. 90045

[21] Appl. No.: 300,616

[22] Filed: Jan. 23, 1989

Related U.S. Application Data

[63] Continuation-in-part of Ser. No. 187,049, Apr. 27, 1988, abandoned.

[51] Int. Cl.[4] ..... F24B 3/00

[52] U.S. Cl. ..... 126/65; 126/29; 126/9 R; 126/4

[58] Field of Search ..... 126/251, 261, 262, 15 R, 126/9 R, 9 B, 2, 77, 25 B, 151, 4, 64–66, 224

[56] References Cited

U.S. PATENT DOCUMENTS

| | | | |
|---|---|---|---|
| 557,537 | 4/1896 | Bartlett | 126/65 |
| 2,446,473 | 8/1948 | Hanna | 126/9 R |
| 2,534,832 | 12/1950 | Schinman | 126/9 R |
| 2,763,321 | 9/1956 | Schuster | 126/151 |
| 2,842,116 | 7/1958 | Hinderer | 126/9 R |
| 3,270,737 | 9/1966 | Horine | 126/9 R |
| 3,359,963 | 12/1967 | Kostial | 126/9 R |
| 4,722,322 | 2/1988 | Varney et al. | 126/261 |

*Primary Examiner*—Larry Jones

*Attorney, Agent, or Firm*—Vernon D. Beehler; William H. Pavitt, Jr.; Ralf H. Siegemund

[57] ABSTRACT

A cooker and/or radiant-heating space heater system comprises a plurality of arcuate sheet metal shell segments assembled with overlapping edge portions so as to form a substantially cylindrical inner shell surrounded by a plurality of similarly overlapping arcuate segments which may be spaced selectively relative to the inner shell and to each other so as to vary the spaces thus defined between the inner shell and the outer segments. The inner shell is spaced above a support surface such as the ground, and the outer segments rest on the support surface so that a combustion zone within the inner shell is in communication with the spaces between the inner shell and the outer segments. For highly efficient combustion, air is drawn down such spaces, due to negative pressure induced by convection over a fire within the combustion zone, and preheated through contact with the hot inner shell prior to entering the combustion zone. Draft control is effected by selectively positioning the outer segments radially with respect to the inner shell. A pot of somewhat lesser diameter than the inner shell may be supported substantially within the inner shell above the fire in the combustion zone for efficient heating of foodstuffs or water in such container. A relatively broad and shallow vessel such as a frying pan or Chinese wok may be supported above the inner shell for heating by radiation and conduction from products of combustion.

36 Claims, 3 Drawing Sheets

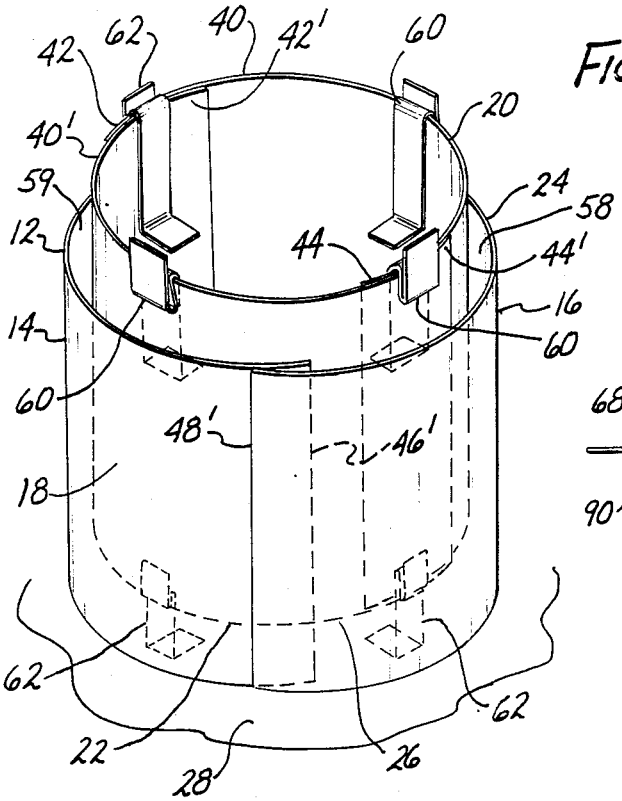
FIG. 1
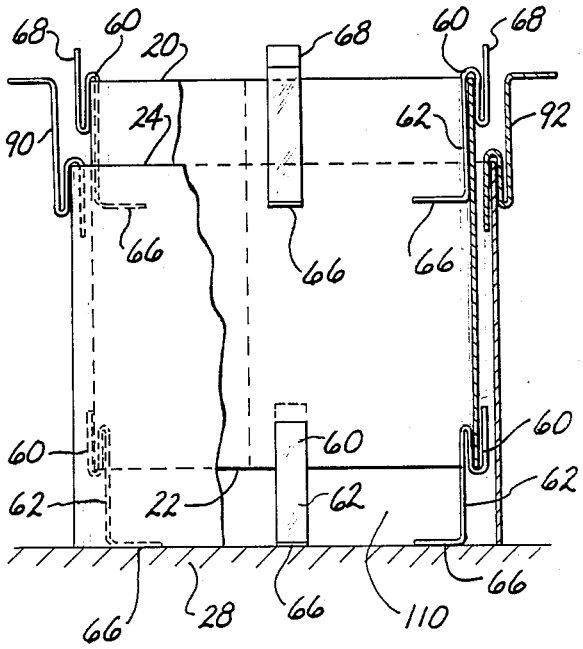
FIG. 2
FIG. 3
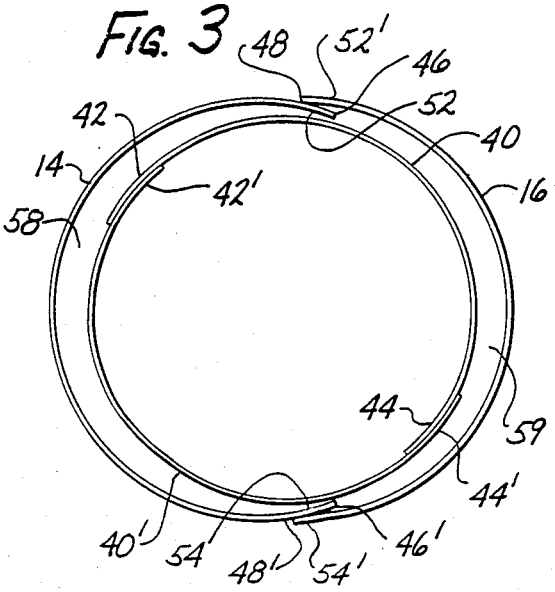
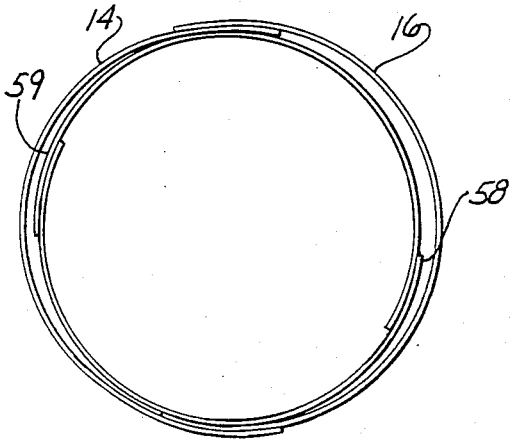
FIG. 4

FIG. 5
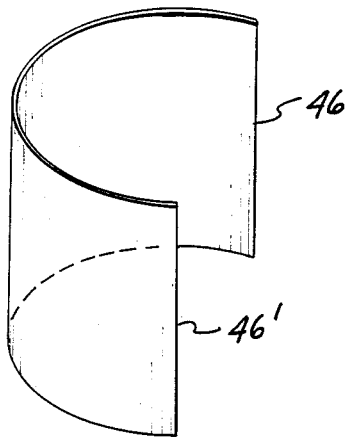
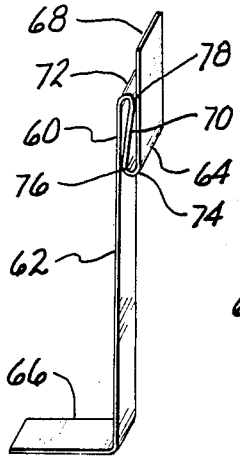
FIG. 6
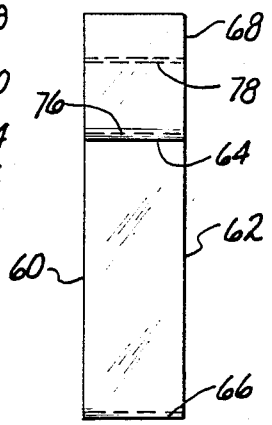
FIG. 7
FIG. 8
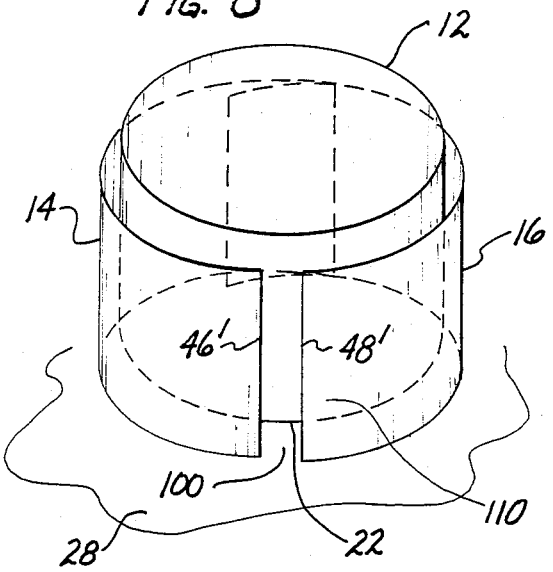
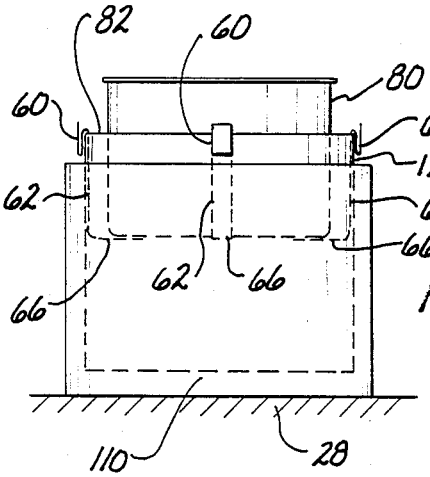
FIG. 9
FIG. 10
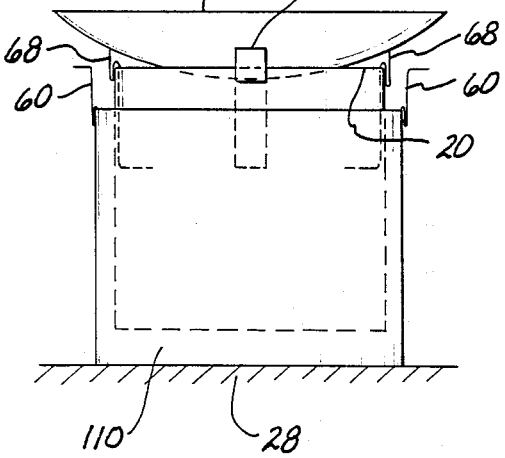
FIG. 11
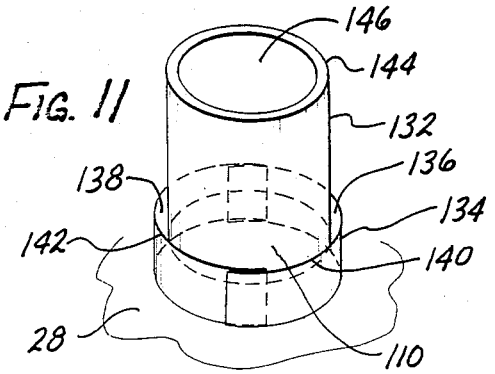

HIGH EFFICIENCY COMBUSTION HEATER

This application is a continuation-in-part of Application Ser. No. 07/187,049 filed Apr. 27, 1988 and now abandoned.

BACKGROUND OF THE INVENTION

1. Field of the Invention

The invention relates generally to combustion heaters and is more specifically directed to portable stoves or furnaces which may be employed for radiant space heating and especially, in combination with suitable containers, for cooking foodstuffs and for heating water with combustible materials under relatively primitive conditions.

2. Description of the Prior Art

The heater/cooker invention set forth herein represents evolutionary advance over the prior art disclosed in U.S. Pat. No. 4,722,322 for "High Efficiency Combustion Heater" dated Feb. 2, 1988. This prior art patent sets forth the technology underlying inventive means by which, in a simple field stove, both combustion of fuels such as wood and transfer of heat from such combustion to a pot for cooking or water heating may be effected with unusually high efficiency. The generic inventive concept is also related to a space heater employing radiant heat as its primary mode of transfer of thermal energy from burning fuel to the surroundings or to individuals in the vicinity.

Numerous carefully controlled tests of these prior art devices for cooking and water heating in a pot have demonstrated system efficiencies in the range of 30% to over 40% determined by measuring temperature rise in a known mass of water resulting from burning a known weight of fuelwood of known heating value per pound. This heating efficiency is .. on the order of 4 to 5 times the efficiency of water heating in a pot over an open fire under commonly encountered conditions.

In the course of conducting the above-noted efficiency tests a number of improvements relating to utility, practicability and especially producibility were found important to practice of the art, notably in developing regions where the advances of powered machine fabrication are limited or non-existent. The present invention is directed to such improvements while preserving the high efficiencies demonstrated by the above-cited prior art devices.

BROAD OBJECTIVES OF THE INVENTION

A primary object of the invention is to provide a heater and/or cooker of the class described which lends itself both by concept and design to rapid, easy and high quality manufacture, given a source of sheet metal blanks, using only forming tools of a rudimentary nature and without electric power, thus permitting fabrication under relatively primitive conditions at low cost and with little investment.

A further object of the invention is to provide in a single embodiment a high degree of flexibility whereby a single set of components may be adjusted readily to adapt to a range of cooking and water heating containers which may already be in the possession of users at the time of acquisition of heaters produced according to the teaching of the present invention.

A further object of the invention is to provide a heater/cooker comprising identical major components and identical minor components whereby a plurality of only two distinct elements suffices to permit assembly of a complete embodiment of the invention without fastenings such as screws, rivets or the like, thus simplifying manufacture, inventory control, shipment and assembly by the end user, including instructions for such assembly.

A further object of the invention is to provide heaters and cookers which can be packaged in an unassembled state for exceptionally dense packing by nesting of large numbers of components. Similarly, all components of a single heater/cooker falling within the present invention can be nested for convenient transport by a user moving from place to place.

A further object of the invention is to provide a heater/cooker of the efficiency characteristics set forth above and in the aforementioned prior art patent which also provides for direct access to a combustion zone within the device through the side wall or outer shell for convenience of initial ignition of a fuel charge within the combustion zone as well as re-ignition by blowing or otherwise in the event of flame-out. A further important object of such access to the combustion zone at or near ground level or other surface supporting the heater assembly is to allow ready introduction of additional fuel pieces as the initial fuel charge burns down. This becomes a particular convenience when a pot is in place for heating in the inner shell. Alternately, access to the combustion zone as described permits insertion of a long stick of fuelwood or two sticks lying side by side on the ground As the ends of such pieces of fuelwood burn off, the sticks can be progressively fed into the combustion zone. Thus a gentle fire can be sustained for long periods as for simmering of foodstuffs requiring extended periods of cooking. It has been found that once the combustion chamber is well heated and a bed of coals established by burning an initial fuel charge, even a single desiccated stick will remain burning, such combustion sustained by pyrolysis of the wood occuring at high temperatures in the confines of the combustion chamber. It may be desirable to close off gaps around the stick or sticks at the point where they pass through an aperture, provided by moving one shell segment cicumferentially with respect to the other, in order to preclude leakage of non-preheated air into the combustion chamber. This can be readily accomplished by heaping sand or earth against the outer shell segments and over the fuelwood pieces so as to close any apparent opening into the combustion zone.

A further object of the invention is to provide highly effective yet conveniently manipulated draft control means integral with combustion air preheat means whereby both the functions of draft control and of preheating combustion air are effected through the same physical components.

A further object of the invention is to achieve a novel combination of elements of such design that only two such elements perform all necessary functions in the assembled heater/cooker and in operation of the device as described hereafter. These two elements are a shell segment and a clip of novel configuration. Four identical, preferably arcuate shell segments may be assembled to comprise the body of the heater/cooker consisting of an inner shell and an outer shell. Ten or more clips, all identical, serve the functions of pot support means within the inner shell, or, alternately, struts for support of relatively broad and shallow cooking vessels above the inner shell; elevation of the inner shell above a support surface such as the ground or hearth, again the clips serving as struts; relatively cool handles affixed to the outer shell segments for manipulation thereof by unprotected hands; and frictional engagement means for securely retaining inner shell segments in the desired semi-permanent, overlapping positions to form the inner shell. It is to be noted that by varying the degree of overlap of adjacent edge portions of the segments comprising the inner shell, the effective diameter of the inner shell may be established to suit the diameter of pot to be supported at least partially within such inner shell. This capability is important to realizing maximum efficiency of heat transfer from flue gasses to such pot by optimizing the width of the effective annulus between shell and pot provided for escape of flue gases. Too restrictive an annulus inhibits combustion; too large an annulus allows hot gases to escape with less-than-maximum transfer of heat to the container immersed in such gases.

A further object of the invention is to provide a cooker/heater which can be quickly and readily converted from its configuration as primarily a cooking device to a configuration primarily serving as a radiant space heater, simply by replacing outer shell segments which largely cover the inner shell with outer shell segments which extend from the supporting surface only to an elevation only slightly above the lower edge of the inner shell spaced above such support surface, thereby exposing almost all of the inner shell to the environment. Thus, when the inner shell is heated to high temperatures—even red heat at times—such heated shell serves as a black-body radiator of high effectiveness for warming the surroundings and, especially, people in the vicinity.

Other objects of the invention will be evident on study of this disclosure, such as achieving a heater/-cooker device of some or all of the properties set forth herein and in the above-cited prior art patent which in some embodiments permit construction of materials or combinations of materials other than sheet metal, such as certain ceramics and ceromets, borosilicate glass, Pyroceram (TM), etc..

SUMMARY OF THE INVENTION

The cooker and/or radiant-heating space heater of the present invention comprises in part a plurality of arcuate preferably sheet metal segments in the form of partial cylinders somewhat over 180° in circumferential extent. It has been found in practice that such cylindrical segments extending through an arc of 220°-230° serve the objects of the invention suitably. The height of such segments of course varies with the desired size of the cooker as related to the size of cooking vessel to be used with the device. A height of segment approximately twice the height of pot to be used has been found satisfactory. The diameter of such segments also varies with the size of pot to be used with the assembled device, a diameter on the order of 120% that of the pot having been found to serve the purposes of the invention used as a high efficiency cooker. Employed as components of the invention used only as a space heater, no such dimensional limitations pertain to size of the segments A reason for providing partial cylindrical segments well over 180° in circumferential extent is to permit two of such segments of identical size to be juxtaposed with overlapping edge portions so as to form a complete cylinder. Such an assembly can then be secured by suitable fastenings to render the assembly semipermanent and substantially rigid to serve as a shell within which a fire can be burned either for space heating, as previously described or for heating a container such as a pot supported within the upper portion of such cylinder or for heating a cooking utensil like a frypan or Chinese wok of diameter larger than the assembled cylinder and suitably supported above the cylindrical shell to allow escape of hot gases rising from the fire within the shell. A further important reason to provide considerable overlap of juxtaposed segments, as described, when such segments are free-standing in a vertical attitude and not joined, relates to desirable flexibility for altering effective diameter of a complete cylinder thus formed. By reducing overlap at the time of joining the juxtaposed segments, a cylindrical form of substantially larger effective diameter than that formed by the same juxtaposed segments in a free-standing state will be realized. Alternately, by urging the unattached segments toward a relative position of greater overlap than in the free-standing state, a substantially cylindrical assembly of reduced diameter may be secured. This feature of the invention satisfies the above-cited objective of providing such flexibility in any given set of components that a range of pot sizes can be accommodated. Since a cooking pot already in the hands of a potential user of the invention represents a valuable asset, adaptability of the inventive combination herein described and set forth is of prime significance. It is found in practice that only two sizes of cylindrical segments when formed of relatively light gage and therefore relatively flexible sheet metal will suffice to adapt to pots ranging from approximately 3—quart or 3—liter working capacity up to 3—gallon or 10—liter or so working capacity.

The arcuate cylindrical segment described above represents a unit, in any given size, which may be employed both for constructing a first cylindrical shell, as set forth above, and for assembling a second housing or shell surrounding the first shell. This may be accomplished by positioning two of such units on opposite sides of the first, now inner, shell so that edge portions of such positioned segmental units overlap, thus forming an effectively continuous closure round the inner shell. It will be understood that such outer segments, identical in the free-standing state to the segments comprising the inner shell, must spring or flex slightly to be placed around the inner shell of nominally the same diameter, due both to the thickness of material and to the fact that, as described above, the arcuate segments extend circumferentially beyond 180°. Thus the edge portions of the outer segments must be forced apart somewhat to pass over the inner cylindrical shell as the outer segments are positioned in close juxtaposition to the inner shell. In such faying relationship, both inner and outer shells may stand on end on a supporting surface, like the ground or a fire hearth or a platform, with effectively no space between shells.

As indicated above, arcuate segments extending through a circumferential span of 220°-230° have been found practical for reasons also indicated heretofore. A further major purpose for using segments thus defined is that such considerable overlap of segments allows radial positioning thereof with respect to the inner shell so that space as desired may be provided between the inner shell and the middle portion of each segment at diametrically opposite sides of the inner shell while still maintaining overlap of adjacent edge portions of the outer shell segments. In operation of the cooker/heater such spaces serve as combustion air intake flue means, as described in the aforementioned prior art patent, in which air is preheated as it flows downward prior to entering the combustion zone. By selective positioning of the outer shell segments, the cross-sectional area of such air intake flue means can be varied at will, whereby close control of the volume of combustion air entering the combustion zone may be effected. With such draft control means fully open, essentially no resistance to inflow of combustion air is afforded. With the outer shell segments snug against the inner shell, essentially no flow of combustion air is permitted. Thus the objective cited above of effecting both combustion air preheating and draft control functions by means of the same components is fully met. Any selected relative position of each outer shell segment with respect both to each other and to the inner shell is maintained in the absence of any force or forces tending to move one or both segments, as may be applied by a user to alter the relative positions of the segments for draft control or other purposes as set forth below. In other words, the outer shell segments remain at rest on the ground or other support surface in whatever position established by the user without additional means for fixing such position.

Necessary communication means for flow of combustion air from the above-mentioned air intake flue means into the combustion zone within the inner shell is provided in the preferred form of the invention by elevating the inner shell somewhat above the supporting surface such as the ground, thus effecting a circumferential aperture or opening between such support surface and the lower edge or rim of the inner shell. With the outer shell segments resting on the support surface, as described above and with adjacent edge portions of such outer shell segments in overlapping relationship, the only available passage for combustion air to enter the combustion zone is via such circumferential opening. Other means for such communication may be provided, such as apertures through the lower portion of the inner shell itself, in which case the inner shell may rest directly on the support surface. However, for simplicity of manufacture, the essentially continuous circumferential opening described above is preferred and may be provided by affixing to the lower edge of the inner shell a plurality of struts which serve to elevate the inner shell above the support surface on which such struts rest. Width of of the opening is established by the length of such struts, which may be spaced at substantially equal intervals around the lower edge of the inner shell. A minimum of three such struts provides appropriate stability in support of the inner shell above the ground or other supporting surface. The width of the circumferential opening thus established by struts, or the height of the lower edge of the inner shell above the support surface, is preferrably not less than that required for essentially unrestricted flow of combustion air when the draft control means is effectively wide open. Somewhat greater elevation of the inner shell above the ground or other support surface is desirable, however, for a number of reasons including provision for some accumulation of ashes within the heater.

It will be recalled from the above description of selective positioning of the outer shell segments that each such segment may be moved laterally or circumferentially with respect to the other segment. Such movement can be effected to the extent of eliminating overlap of two adjacent edge portions while increasing overlap of the other two edge portions. Such rotation can be advanced to the point that separation between adjacent edge portions of the two segments exists. Separation of an inch or so provides convenient access beneath the elevated lower edge of the inner shell directly into the combustion zone. Such direct access allows insertion of a lighted match, for instance, for ignition of a charge of fuel laid on the support surface on which the complete heater assembly rests. Such an opening, of whatever appropriate width, permits blowing by mouth or bellows or otherwise on embers to reignite a fire which has died. Such an opening provides for insertion of fuel pieces as described in the recitation of objectives set forth above. Elevation of the inner shell two inches or so, for example, above the support surface, and separation of adjacent edges of the outer sell segments two inches or so, allows insertion of fuelwood pieces somewhat less in diameter than such an opening into the combustion chamber.

Referring to other objectives listed heretofore in regard to configuration of the inner and outer shell segments, attention is invited to the fact that the somewhat over half-cylindrical segment common to assembly of both inner and out shells allows facile and rapid forming thereof without elaborate tooling or machinery. In fact, such shell segments have been formed satisfactorily by manual bending of a suitably dimensioned blank or flat workpiece of relatively light gage sheet metal over a cylindrical mandrel of appropriate diameter. Thus, partial cylindrical segments as described above lend themselves to fabrication under relatively primitive conditions. Such segments also lend themselves to high density packing by virtue of the fact that they can be nested in large numbers by springing each segment from its over-180° formed state to a curvature slightly under 180° of arc, in which state such cylindrical segments can be stacked without limitation imposed by configuration provided the sheet metal is of light gage and flexible.

A further feature of the invention provided by bifurcation of the outer shell is ready conversion from primary use as a cooker, for efficient heating of a pot or other container for foodstuffs, to primary use as a space heater providing radiant heat to the surroundings and to people in the vicinity. Such conversion is accomplished simply by removing one or both outer shell segments, thereby exposing the inner shell to the environment whereby when hot the shell can radiate thermal energy to the surroundings. To provide draft control and a modicum of preheating of combustion air, outer shell segments similar to those removed for conversion of the device but high enough only to extend to an elevation slightly above the lower edge of the inner shell may be positioned for partially closing of the circumferential gap between the lower edge of the inner shell and the ground or other support surface. Thus, means for draft control is provided by such relatively low outer shell segments while the combustion air preheat function is minimized in favor of radiant heating of the surroundings, An important advantage of such employment of the invention lies in the fact that fuels like dry leaves, grasses, reeds, twigs, animal dung, etc. which do not produce substantial embers for radiation of heat can be used effectively for radiant space heating by burning within a metallic shell which, when heated by conduction from flames and hot gasses within the shell, then emits radiant energy as a black-body radiator. Some portion of heat otherwise lost by convection is thereby converted to useful radiant heat transmitted even in very cold and windy conditions. Noteworthy is the fact that such a radiant space heating embodiment of the invention can be converted to a cookstove embodiment, even while hot from a fire within the inner shell, simply by removing the low outer shell segments described above and replacing them with taller segments substantially identical to those comprising the inner shell. Such replacement can be effected without disturbing the inner shell by virtue of the fact that the outer shell segments of either height can be positioned primarily by lateral movement thereof. Noteworthy also is the fact that the inventive combination described and set forth herewith can serve simultaneously as a cooker and a radiant space heater, if desired, by use of relatively low outer shell segments primarily for draft control and placement of a cooking or water heating utensil in or on the inner shell as hereinbefore described.

An object of the invention, as noted above, is to provide a heater/cooker comprising in its entirety a plurality of two distinct components or elements. One of those elements is the shell segment described and discussed above. The other element is a unitary metal clip which serves a multiplicity of functions. This clip element may be fabricated either of sheet metal or of wire of suitable hardness and stiffness. Cold rolled or cold drawn steel in strip or wire form has been found satisfactory for the several purposes and functions of this unitary element. The clip is so formed as to be adapted to secure frictional engagement with the upper and lower edges of the inner and outer shell segments as heretofore described. The several functions of the unitary clip element of the inventive combination set forth herein may be described as follows in terms of the functions of its sub-elements and their respective configurations.

The clip element has an elongate portion vertically oriented when the clip is attached at any of its assigned positions to the inner shell and to the outer shell segments when they are standing in position for use on the ground or other support surface. Such vertically oriented portion of the clip element serves as a strut when the clip is affixed to the lower edge or rim of the inner shell for the purpose of elevating or spacing that shell above the support surface as hereinbefore described and for purposes also set forth. A plurality of such struts, but not less than three, spaced circumferentially and at substantially equal intervals around the lower rim of the inner shell provides stable support for the shell resting on the ground or other support surface. Four such struts is the preferred number, for reasons set forth below.

The vertically oriented, elongate portion of the clip element serves a second function, namely, to space a support sub-element of the clip below the upper rim of the inner shell for support of a pot partially within the inner shell and above a fire within the combustion zone of the cooker/heater. Such support sub-element, integral with the vertically oriented, elongate portion of the clip, extends radially inward from the wall of the inner shell. A plurality of such clips, but not less than three, substantially equally spaced about the upper rim of the inner shell and depending therefrom, provides a stable support structure for a pot. Four of such pot support clips is the preferred number thereof, for a reason made clear below.

A third function of the unitary clip element is to serve as clamping means for holding securely together the two segments which comprise the inner shell. At both areas of overlap, adjacent both the top edge and the bottom edge of the inner shell, such clamping means engage the shell frictionally so that the faying portions of the shell segments are pressed together and thus secured. The clamping sub-element of the unitary clip comprises, in the preferred sheet or strip metal construction thereof, an end portion folded back on itself twice in the form of a "Z" which has been compressed to the point that the three strokes of the letter are substantially parallel. The clamping portion of the clip thus formed allows a thin sheet of metal to be forced in between the substantially faying surfaces of the folded strip. As a corollary, such a clamping portion of the clip can be pressed in either of two directions on to the edge of a sheet metal piece such as one of the shell segments of the present invention. Thus, such a double-acting clamp portion of the clip can serve to allow the clip to be used as a strut, as heretofore described, affixed to the lower edge of the inner shell; and the identically configured clip can be depended from and clamped on to the upper edge or rim of the inner shell and on the inside thereof, thus providing pot support means on opposite sides of the shell where the clips serve to clamp the overlapping portions of the shell segments. It is clear that two more clips serving as pot support means are needed for stable support of a pot within the shell. Such stable support is provided by positioning such clips oh opposite sides of the shell and midway between the first two pot support clips mentioned above. Hence the preferred number of four such pot support clips as indicated above. Similarly, four clips employed as struts are needed for stability of the inner shell. Two such strut clips serve to clamp the lower portions of the overlapping edges of the shell segments. The remaining two strut clips are positioned on opposite sides of the shell midway between the first two strut clips mentioned.

In connection with use of the unitary clip as pot support means it was noted above that a sub-element of the clip extends radially inward, providing a supporting surface on which the pot can rest. This same sub-element of the clip when such clip is employed as a strut assumes the function of a foot or broad base integral with the strut proper. Such foot-like sub-element serves the useful purpose of providing footprint area whereby the strut is prevented from sinking far into soft earth or sand when such material represents the support surface underlying the assembled cooker/heater.

A fourth function of the unitary clip element is that of relatively cool handle for manipulating an outer shell segment for purposes of draft control, for instance, especially when the cooker/heater is in use and hot. By affixing one of such clip elements to the mid-portion of the upper edge of each outer shell segment so that the elongate portion extends upward from the shell segment and the foot-like sub-element of the clip extends radially outward, a convenient and relatively cool handle is provided for manipulation of the shell segment by bare hand even when the inner shell is exceedingly hot. This radially extending handle portion of the unitary clip element remains relatively cool by virtue of its relative isolation from the hotter, lower portion of the outer shell segments and also because of being bathed by cool outside air as such air is drawn into the combustion air intake flue means. In larger embodiments of the invention in which the outer shell segments may be relatively heavy and somewhat awkward to manipulate with one hand, two such handle clips spaced apart along the upper edge of each outer shell segment allow use of both hands for manipulation of each outer shell segment.

A fifth use of the unitary clip element is as support means for an alternative cooking container or utensil positioned above the inner shell when such utensil is of diameter larger than that of the inner shell and therefore cannot be supported within the confines of the inner shell as is the preferred practice with deeper containers like a pot, as discussed heretofore and in the prior art patent cited above. For this use of the unitary clip element, a plurality of such elements affixed to the upper edge of the inner shell, as hereinbefore described, may be provided with moderately elongate portions of the clamping sub-element portion of the clip element to extend upward and thereby provide short strut-like means to elevate the utensil to be thus supported above the inner shell. In the case of a Chinese wok, for instance, characterized by a relatively large diameter spherical segment shape, or a large frying pan, it is clear that the short strut-like portions of the clips as described above should extend so as to elevate a broad cooking utensil positioned thereon sufficiently above the upper rim of the inner shell to permit escape of products of combustion rising from a fire within the inner shell. Use of such relatively short upward extending clip sub-elements serves to maximize transfer of both radiant heat from burning embers as well as conductive heat from flame and escaping products of combustion. Thus a relatively small fire and burning of little fuel may suffice to heat the cooking utensil as required in any given instance of food preparation.

Attention is invited to the fact that the entire cooker/heater inventive combination described and set forth herewith is constructed of components assembled without use of fastenings of any sort other than the unitary clip element discussed above. This feature of the invention does away with need for drilling or punching of holes for fasteners commonly employed in such assemblies, with fasteners themselves which usually require machine manufacture, with installation of standard fasteners which normally require tools for securing such fasterners, and with inventory control problems commonly encountered in assuring availability of such small parts at points of assembly, especially in areas remote from sources of supply. Thus an important object of the invention, as set forth heretofore, has indeed been met, namely, adaptation of the device to manufacture in what has come to be known as cottage industry as well as to assembly of the cooker/heater device by potential users thereof.

It may also be noted that, whereas the device herein described and set forth lends itself especially to the requirements of Third World manufacture and use, the invention also lends itself to high-volume machine production in sizes and configurations adapted to recreational uses such as back-packing, camping, patio and beach radiant heating, etc. in the more affluent areas of the world.

BRIEF DESCRIPTION OF THE DRAWINGS

FIG. 1 is an isometric view taken from above a combustion heater constructed according to the present invention except that handle means are removed from the outer shell segments for clarity of depiction.

FIG. 2 is a side elevation view partially in section of a heater constructed according to the present invention.

FIG. 3 is a top plan view of the heater shown in FIG. 1 and FIG. 2 with unitary frictional engagement elements removed for clarity of depiction of the inner shell and the outer shell comprising arcuate segments.

FIG. 4 is a top plan view of the heater shown in FIG. 3, also with unitary frictional engagement elements removed for clarity, with outer shell segments shown in positions such that their mid-portions are respectively relatively close to the inner shell, whereby the cross-sectional area of the spaces between the inner shell and the outer shell segments is relatively restricted.

FIG. 5 is an isometric view, taken from above, of a shell segment a plurality of which may be employed to form both the inner shell and the outer shell of the present invention.

FIG. 6 is an isometric view taken from one side of a unitary clip serving variously in the assembly of a combustion heater constructed according to the present invention.

FIG. 7 is a side elevation view of the unitary clip or frictional engagement means shown in FIG. 6.

FIG. 8 is an isometric view, taken from above and in outline form, with unitary clip elements removed for clarity, of a heater constructed according to the present invention shown with outer shell segments moved laterally and/or rotationally with respect to each other so as to provide a space between adjacent edges of the shell segments on one side of the heater.

FIG. 9 is a schematic side elevation view of a heater constructed according to the present invention with a pot supported within the inner shell by a plurality of unitary frictional engagement means as depicted in FIG. 6 and FIG. 7.

FIG. 10 is a side elevation view, in outline form, of a heater constructed according to the present invention with a Chinese wok shown resting on upward extensions of the unitary frictional engagement means depicted in FIG. 6 and FIG. 7.

FIG. 11 is an isometric view, taken from above and in outline form, of a heater constructed according to the present invention in an embodiment for primary use as as a space heater in which the inner shell is largely exposed to the surroundings for direct radiation from such inner shell when heated by a fire within the heater.

DETAIL DESCRIPTION OF THE PREFERRED EMBODIMENTS

Figure 12:
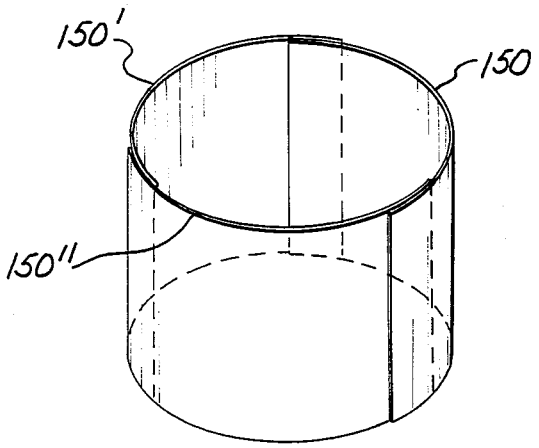
FIG. 12 is an isometric view, taken from above and in outline form, with unitary clip elements removed for clarity, of a heater shell constructed according to the present invention and comprising three overlapping shell segments the combination of which juxtaposed as shown comprise a substantially cylindrical body open at each end.

With reference to the drawings, FIG. 1 shows a high-efficiency combustion heater in a basic embodiment of the present invention consisting of a tubular shell element 12 surrounded by partial cylindrical segment 14 cooperating with partial cylindrical segment 16 to form an outer shell 18 girdling inner shell element 12. Inner tubular shell element 12 terminates in upper rim 20-and lower rim 22 and is open at both ends. Outer shell 18, comprising partial cylindrical segment 14 and partial cylindrical segment 16, terminates in upper rim 24 and lower rim 26 and is open at both ends. Lower rim 26 of outer shell 18 rests on support surface 28 which may be the ground or a hearth or an ash pan or the like. Lower rim 22 of inner shell 12 is elevated above support surface 28 by strut element 62 of frictional engagement means 60. A plurality of strut element 62 spaced about 90° apart about lower rim 22 of inner shell 12 provides stable support for inner shell element 12 spaced above support surface 28 as best seen in side elevation view partially in section FIG. 2.

In the preferred embodiment of the present invention, inner shell element 12 consists of two cylindrical segments 40 and 40', respectively, of the same radius and of circumferential span somewhat over 180° so that, when juxtaposed to form inner shell element 12, edge portions 42 and 42' of segments 40 and 40', respectively, overlap and edge portions 44 and 44' of segments 40 and 40', respectively, similarly overlap as best seen in top plan view FIG. 3 as well as in FIG. 1. It will be understood, however, that inner shell element 12 may be unitary and consist of a single sheet of material so formed as to present a tubular body or, in fact, inner shell element 12 may be seamless and of suitable non-metallic material like heat-resistant glass or ceramics, for instance, of appropriate thermal conductivity for purposes of the present invention. The preferred embodiment of the present invention, however, employs for inner shell 12 a plurality of flexible metallic segments 40 and 40' as described and depicted in FIG. 1, FIG. 2, FIG. 3, FIG. 4, FIG. 5 etc. for a number of reasons including the fact that such flexible cylindrical segments my be juxtaposed, as hereinbefore set forth and described, with varying degrees of overlap of edge portions 42 and 42' as well as with varying degrees of overlap of edge portions 44 and 44', whereby the effective diameter of inner shell element 12 may be varied considerably and selectively so as to conform to pots in a range of diameters as hereinafter described and depicted in FIG. 9. A desired working diameter of inner shell 12 may thus be realized by clamping together overlapping edge portions 42 and 42' as well as overlapping edge portions 44 and 44' at such relative circumferential positions as to yield a desired circumference of inner shell element 12, and therefore desired effective diameter thereof. Whereas arcuate segments 40 and 40' may lie freely in intimate juxtaposition over the span of overlapping portions only at the radius of curvature at which segments 40 and 40' were formed, at other radii of curvature imposed on segments 40 and 40' in order to increase or decrease the effective diameter of inner shell element 12, overlapping edge portions 42 and 42' as well as overlapping portions 44 and 44', respectively, may be readily clamped into intimate faying and fixed relationship by employment of unitary frictional engagement means 60 best seen in FIG. 6 and FIG. 7. Unitary frictional engagement means 60 incorporates two spring clamping portions, hereinafter described and depicted in detail, which in the preferred embodiment are thrust over the lapping areas of edge portions 42 and 42' as well as over the lapping areas of edge portions 44 and 44' at the upper rim 20 and lower rim 22 of inner shell element 12. Preload in the spring clamping portions of frictional engagement means 60 assures secure frictional engagement between faying portions of arcuate segments 40 and 40' so as to assure integrity of composite inner shell element 12 when assembled as described.

FIG. 3 shows outer shell 18 in its girdling relationship with inner tubular shell element 12 and comprising partial cylindrical element 14 and partial cylindrical element 16. As in the case of inner shell element 12, consisting of segment 40 and segment 40', outer shell segment 14 and outer shell segment 16 in the preferred embodiment are substantially identical and of circumferential span somewhat over 180° so that when positoned diametrically opposite each other in a girdling relationship with inner shell element 12, edge portions 52 and 52' of segments 14 and 16, respectively, and edge portions 54 and 54' of segments 14 and 16, respectively, overlap and are contiguous so as to form outer shell 18 with no break in a continuous wall surrounding inner shell element 12.

In the preferred embodiment of the present invention, outer shell segment 14 and outer shell segment 16 are formed of flexible sheet material and at substantially the same radius of curvature as inner shell segments 40 and 40'. Employment of relatively thin sheet metal, such as the galvanized sheet iron commonly used in the fabrication of 5-gallon water cans, permits easy outward flexure of partial cylindrical segments 14 and 16. Since outer shell segment 14 is of the same radius of curvature as that of inner shell 12, and outer shell segment 14 is of circumferential span greater than 180°, vertical edges 46 and 46' normally lie at a distance apart less than the diameter of inner shell 12. Therefore, radial movement of outer shell segment 14 relative to inner shell 12 from a position not in contact with inner shell 12 to a position beyond that at which edges 46 and 46' make contact with inner shell 12 requires the aforementioned flexure. Maximum flexure on continuation of such radial movement of outer shell 14 is required as edges 46 and 46' pass over lines of contact with inner shell 12 at opposite ends of a diameter, so to speak, or over lines on the outer surface of inner shell 12 representing the intersections of such surface with a vertical plane passing through the centerline of inner shell 12. As such radial movement of outer shell 14 continues to bring the midpoint of outer shell segment 14 in closer proximity to inner shell 12, edges 46 and 46' of outer shell 14 remain in contact with inner shell 12 and draw closer together, whereby flexure of outer shell segment is inward and toward the free-standing curvature thereof. It is clear that the material of which outer shell 14 is fabricated must exhibit not only flexibility but resilience and elastic properties sufficient to undergo flexure as described above without exceeding its elastic limit. In practice it is found that ordinary cold- or even hot-rolled steel sheet of relatively light gage exhibits entirely adequate elasticity for the purposes and needs of the present invention.

In the preferred embodiment of the invention, outer shell segment 16 is substantially identical in every respect to outer shell segment 14 described above. In radial movement to a position with respect to inner shell 12 and to outer shell 14 as shown in FIG. 3, however, flexure of outer shell segment 16 to allow edges 48 and 48' thereof to pass outside edge portions 52 and 54 of outer shell segment 14 is required. In this case, the flexure required of outer shell segment 16 is somewhat greater than that of outer shell segment 14. The depiction of FIG. 3 shows edge portions 52' and 54' of outer shell segment 16 lying outside edge portions 52 and 54, respectively, of outer shell segment 14. It will be apparent that, alternately, edge portion 54' of outer shell segment 16 may lie inside edge portion 54 of outer shell segment 14 while the overlapping relationship of edge portions 52 and 52' on the opposite side of the assembly remain as shown in FIG. 3, thus minimizing required flexure of both outer shell segments during manipulation thereof for assembly of the high-efficiency combustion heater herein depicted and set forth.

FIG. 4 shows a preferred embodiment of the present invention, as depicted in FIG. 1, FIG. 2 and FIG. 3, with outer shell segments 14 and 16 positioned so as to reduce the cross-sectional area of spaces 58 and 59 between inner shell 12 and surrounding outer shell segments 14 and 16, respectively, relative to the cross-sectional area of spaces 58 and 59 when outer shell segments 14 and 16 are postioned radially so that their respective midportions are farther apart, as shown in FIG. 3. The spaces thus defined may be varied in cross-sectional area simply by positioning outer shell segments 14 and 16 at any desired degree of radial separation from inner shell 12 as they rest on support surface 28. As hereinafter described, these spaces represent combustion air intake ducts. Varying the cross-sectional area of such ducts therefore represents a highly effective means of controlling draft to a fire within the combustion heater constructed according to the present invention.

FIG. 5 shows an individual shell segment a plurality of which may be used to construct both inner shell element 12 and outer shell 18 by juxtaposition of such shell segments as described and set forth above. In the preferred embodiment of the invention such shell segments are made of material of such flexibility as will provide the flexure of degree indicated for assembly and manipulation as described above but also sufficient to permit stacking or nesting without limitattion imposed by configuration of the shell segment itself. It will be apparent that such stacking requires flexure of individual units to a somewhat more open state wherein parallel straight edges 46 and 46' lie at least as far apart as twice the radius of curvature of the cylindrical shell segment standing free and unrestrained. In practice it has been found that cold rolled steel of light gage formed to partial cylindrical segments as herein described and depicted at somewhat over 180° of circumferential span can be stacked or nested in large quantity for high density stowage as for warehousing and shipment.

FIG. 6 shows in isometric view a unitary frictional engagement means or clip 60 employed variously in construction of the preferred embodiment of the present invention. Clip 60 consists of elongate portion 62 unitary with spring clip portion 64, lateral extension portion 66 and upward extension portion 68. Overall dimensions of clip 60 preferably relate proportionately to the general size of the cooker/heater with which it will be employed. The gage of material of which clip 60 is fabricated preferably relates to the weight of the cooker/heater and to the weight of a cooking or water-heating container which may be used in conjunction with the cooker/heater of the present invention since elongate portion 62 serves as a strut in its function in support of inner shell element 12 above a support surface 28, thus carrying compressive, bending and potentially buckling loads. Lateral extension portion 66 serves in dual capacities of pot support means within inner shell element 12 and as a foot associated with elongate portion 62 in its function as a strut, as indicated above, whereby the cooker/heater of the present invention may be supported with adequate stability and without excessive sinking into soft earth or sand which may provide support surface 28. In its capacity as pot support means, lateral extension portion 66 is subjected to bending loads since such portion is cantilevered inward from the wall of inner shell element 12, as depicted in FIG. 1 and FIG. 2. A plurality of such pot support means provides stable and structurally adequate support for a pot 80 situated within inner shell 12, as shown schematically in outline form in FIG. 9, provided that the gage of material used in fabrication of frictional engagement means 60 is appropriate to the bending loads thus imposed.

The gage of material as well as width of strip from which frictional engagement means 60 is fabricated in the preferred embodiments of the invention are also influenced by the function of gripping or clamping served by frictional engagement means 60 in its several capacities in construction of the heater/cooker of the present invention. As shown in FIG. 6, spring clip portion 64 of frictional engagement means 60 is formed by folding the strip back on itself twice so that an intermediate portion 70 lies between elongate portion 62 and upward extension portion 68. Elongate portion 62 joins intermediate portion 70 through bend 72, and intermediate portion 70 joins upward extension portion 68 through bend 74. Intermediate portion 70 bears against elongate portion 62 along a line 76 near the juncture of intermediate portion 70 and bend 74. Upward extension portion 68 bears against intermediate portion 70 along a line 78 near the juncture of intermediate portion 70 and bend 72. In the preferred embodiment of unitary frictional engagement means 60, preload between faying portions thereof along lines of contact 76 and 78 is established by initially forming bends 74 and 72, respectively, at a somewhat larger radius of curvature than in the finished artifact. Such initial bends can readily be made so that elongate portion 62, intermediate portion 70 and upward extension portion 68 lie substantially parallel and spaced apart. A subsequent compressing operation, as between the parallel faces of the jaws of a vise, forces elongate portion 62 and upward extension portion 68 into closer proximity as intermediate portion 70 assumes a non-parallel attitude as shown in FIG. 6 with bends 72 and 74 becoming effectively smaller or of reduced radius of curvature. The result of such secondary forming operation is marked preload between faying portions of frictional engagement means 60. Such preload is desirable in establishing secure frictional engagement with inner shell 12 and with outer shell segments 14 and 16 as hereinafter set forth and described. The extent of such preload can be influenced by selection of material of which frictional engagement means 60 is made, by the degree to which bends 72 and 74 are compressed and by the length and width of intermediate portion 70. The several functions of unitary frictional engagement means 60 serving as a clip at various points in the overall construction of the present invention will now be understood and can be explained as follows in conjunction with the drawings.

Heretofore the function of frictional engagement means 60 as a clamping device for securing overlapping edge portions 42 and 42' of segments 40 and 40' of inner shell 12 was described. Also described was the function of elongate portion 62 of frictional engagement means or clip 60 serving as a strut for support of inner shell element 12 spaced above a support surface 28 as best shown in FIG. 2. FIG. 1 and FIG. 2 depict frictional engagement means 60 depended from upper rim 20 of inner shell element 12 so that lateral extension portion 66 extends radially inward from inner shell element 12 to be in position to support a cooking or water heating container 80 as shown schematically in FIG. 9. Elongate portion 62 of frictional engagement means 60 serves to space lateral extension portion 66 below upper rim 20 so as to support container 80 partially within inner shell 12 as well as above a fire laid on support surface 28 and within the enclosure provided by inner shell element 12 and outer shell 18. The two frictional engagement means 60 positioned and employed as clamping means for joining together inner shell segments 40 and 40' along upper rim 20 of inner shell element 12 in combination with two more of frictional engagement means 60, spaced opposite each other and substantially midway between those frictional engagement means 60 employed as clamping means, provide stable support for container 80. In each instance of engagement of frictional engagement means 60 with inner shell 12, frictional enagagement means 60 is thrust into position over upper rim 20 or lower rim 22, as the case my be, by introducing the edge of such rim between faying portions of frictional engagement means 60 to effectively wedge such faying portions apart against the preload biasing such faying portions together, as hereinbefore described. When frictional engagement means 60 is driven to its limit position, at which position the edge of either upper rim 20 or lower rim 22, as the case may be, is seated against the inside of either bend 72 or bend 74, as the case may be, of frictional engagement means 60, the frictional grip thus established plus mechanical engagement of the parts securely fixes unitary frictional engagement means 60 in whatever location and for whatever purpose in construction of the present invention such attachment is indicated.

Two additional functions in use and manipulation of the present invention are served by unitary frictional engagement means 60. FIG. 1 and FIG. 2 show this element of the invention serving as handles 90 and 92 attached to outer shell segments 14 and 16, respectively. Elongate portion 62 of unitary frictional engagement means 60 extends upward from upper rim 24 to elevate lateral extension portion 66 to a level adjacent upper rim 20 of inner shell 12 so that lateral extension portion 66 remains relatively cool and therefore convenient to handle even during a hot fire burning within the cooker/heater of the present invention. Handles 90 and 92 are employed by the user of the present invention for manipulation of outer shell segments 14 and 16, respectively, for purposes of draft control, as hereinbefore described, as well as for moving either shell segment 14 or shell segment 16, or both, laterally for the purpose of effecting an opening 100, as depicted in FIG. 8, between vertical edge 46' and vertical edge 48' of outer shell segment 14 and outer shell 16, respectively. Opening 100 allows direct access to combustion zone 110 via a route beneath lower rim 22 of inner shell 12 and above support surface 28. Such direct access facilitates ignition of a fuel charge laid on support surface 28 within combustion zone 110 by means of a match or the like. Such access also permits blowing on embers to reignite a fire which may have lost its flame. Such access also permits introduction of fuel pieces into combustion zone 110 when access from above is restricted by presence of a cooking or water heating container in or over inner shell 12. Such access for long fuel pieces permits introduction of one end of a long stick of wood, for instance, into combustion zone 110 which stick may then be burned off a bit at a time. Opening 100, adjustable in width by virtue of the ability to move outer shell segment 14 or outer shell segment 16 laterally, is thus capable of being made just wide enough to allow a stick or a cluster of sticks to pass through opening 100 for maintaining a protracted fire. Leakage of air into combustion zone 110 may be prevented readily by heaping earth or sand against outer shell 18 and lower rim 22 of inner shell 12 adjacent opening 100 to close off spaces around such stick or sticks entering opening 100. Such leakage would allow combustion air required for supporting a fire within combustion zone 110 to bypass air intake ducts represented by spaces 58 and 59 as best seen in FIG. 3 and FIG. 4. Such leakage would at least in part counteract the draft control and combustion air preheat functions served by outer shell 18.

FIG. 10 shows schematically, in side elevation view, an embodiment of the present invention employed to support a cooking vessel of larger diameter than that of inner shell 12, in this illustration a typical Chinese wok. Vessel 120 rests on upward extension 68 of frictional engagement means 60 which serves to elevate vessel 120 above upper rim 20 of inner shell 12 to allow escape of products of combustion rising from a fire within combustion zone 110. An annular space of one-half inch or so between upper rim 20 of inner shell 12 and the under surface of vessel 120 has been found in practice to suffice for escape of such combustion products from a suitably small fire for cooking in such a vessel employed with the present invention.

FIG. 11 shows an embodiment of heater of the present invention in a configuration primarily directed to its use as a radiant energy space heater. In such a configuration, inner shell element 132 is largely exposed to the environment for radiation of heat for warming persons and things in the immediate or near vicinity. Outer shell 134 surrounds inner shell 132 for porposes of draft control and a modicum of preheating of combustion air entering combustion zone 110 via spaces 136 and 138 between outer shell segments 140 and 142, respectively, and inner shell element 132. The upper rim of outer shell segment 140 and the upper rim of outer shell segment 142 are at an elevation relative to support surface 28 well below the elevation of upper rim 144 of inner shell element 132 relative to support surface 28 so that the greater part of the outer surface of inner shell element 132 radiates directly to the surroundings when heated by a fire within combustion zone 110. Flue damper 146 may be positioned fixedly within the upper end of inner shell element 132, or rotatably after the manner of the well known stove pipe damper, for purposes of controlling efflux of combustion products. Flue damper 146 and outer shell segments 140 and 142 serving as draft control means may be manipulated to optimize quality of a fire within combustion zone 110 to the end of maximizing transfer of conductive heat within inner shell element 132 to radiant heat emitted by inner shell element 132 acting as a black body radiator. Treating the surfaces, both interior and exterior, of inner shell element 132 to produce a dull black finish can enhance the radiation properties of inner shell element 132. In embodiments of the invention directed primarily to uses with cooking vessels, as depicted in FIGS. 1, 2, 8, 9 and 10, overall efficiency of the present invention can be enhanced by use of material for outer shell segments 14 and 16 which is reflective on both inside and outside surfaces, whereby heat radiated by inner shell element 12 is largely reflected to further heat inner shell element 12, and that portion of the radiant heat from inner shell element 12 not reflected back to further heat inner shell element 12, and therefore is absorbed by outer shell segments 14 and 16 to cause heating thereof, is minimally radiated outward by outer shell segments 14 and 16.

FIG. 11 shows an embodiment of heater of the present invention in a configuration primarily directed to its use as a radiant energy space heater. In such a configuration, inner shell element 132 is largely exposed to the environment for radiation of heat for warming persons and things in the immediate vicinity. Outer shell 134 surrounds inner shell 132 for purposes of draft control and a modicum of preheating of combustion air entering combustion zone 110 via spaces 136 and 138 between outer shell segments 140 and 142, respectively, and inner shell element 132. The upper rim of outer shell segment 140 and the upper rim of outer shell segment 142 are at an elevation relative to support surface 28 well below the elevation of upper rim 144 of inner shell element 132 relative to support surface 29 so that the greater part of the outer surface of inner shell element 132 radiates directly to the surroundings when heated by a fire within combustion zone 110. Flue damper 146 may be positioned fixedly within the upper end of inner shell element 132, or rotatably after the manner of the well known stove pipe damper, for purposes of controlling efflux of combustion products.

FIG. 12 depicts an embodiment of the composite shell configuration of the present invention comprising three similar segments 150, 150' and 150'' respectively of such circumferential spa as to overlap considerably when juxtaposed so as to form a complete cylindrical body. The body shown may be either the inner shell or the outer shell of the complete combustion heater assembly. When serving as the outer shell as hereinbefore described, the individual segments may be positioned either snugly against the inner shell for minimizing flow of combustion air between the inner and outer shells as such air is drawn into the combustion chamber, or the individual outer shell segments may be positioned selectively apart from the inner shell so as to increase flow of combustion air. A major advantage of such tripartite construction of both inner and outer shells lies in the fact that considerably more adjustability is provided for altering the effective diameter of the stove, whereby a large variety of pot diameters can be accommodated by a single set of shell segments.

Operation of the present high efficiency combustion heater is similar to that of the prior art heater discussed and depicted in U.S. Pat. No. 4,722,322 cited above, especially as regards thermodynamic efficiency. Important distinctions and improvements over the prior art pertain in the present invention, however, with respect to facility with which the device can be used for a variety of heating and cooking purposes. Initially, inner shell element 12 can be readily adjusted in diameter, as described above, to adapt the cooker to a particular size of pot already in possession of a user. Although such adjustability has practical limits, of course, in practice it has been found that only two basic sizes of cooker constructed according to the present invention can be adjusted to accommodate the great majority of cooking pots in common use. Inner shell element 12 is to be adjusted in diameter so as to provide an annular space 82 between inner shell element 12 and pot 80 as shown in FIG. 9. Annular space 82 provides for escape of combustion products from a fire within combustion zone 110 and in practice has been found to be optimal at a width approximating the diameter of the assembler's finger at any point about the circumference of the pot when situated within the cooker as shown in FIG. 9. Too narrow an annulus 82 tends to smother the fire. An excessively wide annulus 82 tends to diminish efficiency of heat transfer from hot exhaust gases to pot 80.

A second improvement over the prior art relates to facility with which a fuel charge can be laid and subsequently ignited within combustion zone 110. Since outer shell segments 14 and 16, or their counterpart outer shell segments 140 and 142 in the space heater embodiment shown in FIG. 11, can be readily removed from their normal positions fully surrounding or girdling inner shell element 12, or inner shell element 132 in the heater embodiment of FIG. 11, it is convenient to construct a fuel charge for ignition, that is, with kindling, by placement of fuel pieces on support surface 28 within combustion zone 110 by introducing such fuel pieces from the side, beneath lower rim 22 as shown most clearly in FIG. 2 and between strut-like elongate portions 62 of unitary frictional engagement means 60. Particularly if a wind is blowing so that starting an unsheltered fire is difficult, outer shell segments 14 and 16 can be placed in positions adjacent inner shell element 12, as depicted in FIG. 8, to provide nearly complete closure about a fuel charge to be ignited, leaving only such small opening 100 as necessary to allow insertion of a lighted match or other means of ignition. In practice it has been found that fires can be started in the present inventive combustion heater even when such heater is exposed to strong winds blowing from the side opposite that of opening 100. Outer shell segments 14 and 16 can, of course, be positioned so as to place opening 100 on the lee side of the heater when so exposed to a breeze or strong wind.

A third operational improvement over the prior art devices relates to the facility with which draft control to optimize flow of combustion air to a fire within combustion zone 110 is achieved in the present invention. As heretofore discussed, outer shell segments 14 and 16, or outer shell segments 140 and 142 in FIG. 11, can be manipulated by means of handle means 90 and 92 best seen in FIG. 2 to selectively vary the cross-sectional areas of spaces 58 and 59, which, as noted above, represent combustion air intake ducts leading from the upper rim 24 of outer shell 18 to lower rim 22 of inner shell element 12 at which point such ducts are open into combustion zone 110. Combustion air is drawn down such air intake ducts when a fire is burning in combustion zone 110 by virtue of convection of heated air and combustion products above such fire. The volume of such combustion air entering combustion zone 110 is determined by the strength of such convection and by the effective size of air intake ducts represented by spaces 58 and 59 as determined by the user's positioning of outer shell segments 14 and 16 relative to inner shell element 12.

While the preferred embodiments of the present invention have been described and depicted for purposes of explanation and clarity, modifications and substitutions will become apparent to those skilled in the art without departing from the spirit and scope of the present invention which is defined only by the following claims. For instance, it is immediately apparent that the functions and uses of unitary frictional engagement means 60, as employed in the present invention and in the embodiment shown in FIG. 6 and FIG. 7 as an artifact fabricated from sheet or strip metal, can be realized by a similar clip made of wire and formed to provide the gripping and strut and spacing and support and foot means incorporated in unitary frictional engagement means 60 of the present invention.

What is claimed is:

1. A fuel burning heater comprising:

inner shell means, outer shell means surrounding said inner shell means, said inner shell means and said outer shell means defining therebetween air intake flue means, means closing the lower end of said outer shell means to define a combustion zone within said shell means, said combustion zone being in communication with said air intake flue means, and said outer shell means comprising a plurality of segments movable to selected positions relative to each other and said inner shell means whereby said air intake flue means may be varied in cross-sectional area for adjustably controlling the flow of air reaching said combustion zone during burning of the fuel therein.

2. The heater of claim 1 including container means supported at least partially within said inner shell means and defining therewith an exhaust flue surrounding said container means for hot combustion gases rising from a fire within said combustion zone.

3. The heater of claim 1 in which at least one of said shell segments of said outer shell can be displaced laterally whereby an opening may be provided for direct access to said combustion zone adjacent said lower end of said outer shell means.

4. The heater of claim 1 in which said inner shell means is heat-conductive whereby air flowing down said intake flue means is heated by contact with said inner shell means when said inner shell means is heated by a fire within said combustion zone.

5. The heater of claim 1 in which said inner shell means comprises a plurality of arcuate segments retained in spatial relation to each other so as to form a substantially cylindrical body open at both ends.

6. The heater of claim 5 in which said plurality of arcuate segments is fixedly retained by frictional engagement means.

7. The heater of claim 5 in which said plurality of arcuate segments is changeably retained by frictional engagement means whereby the effective diameter of said substantially cylindrical body may be selectively varied.

8. The heater of claim 6 in which said frictional engagement means incorporate unitary means for support of said inner shell means in spaced relationship to said means closing the lower end of said outer shell means whereby said combustion zone is in communication with said air intake flue means.

9. The heater of claim 6 in which said frictional engagement means incorporates unitary means adapted to support a utensil positioned over said combustion zone for heating said utensil and its contents.

10. The heater of claim 1 in which said outer shell segments are substantially arcuate in cross-section and are disposed in circumferentially overlapping and contacting relation with each other.

11. The heater of claim 1 in which each of said inner and outer shell means comprises a plurality of flexible cylindrical segments.

12. The heater of claim 11 in which all said segments are substantially identical whereby said segments are interchangeable in construction of said heater.

13. The heater of claim 11 in which all said segments are substantially identical whereby said outer shell segments and inner shell segments are interchangeable in construction of said heater.

14. The heater of claim 1 in which said inner shell means is of substantially greater height than the outer shell means whereby that portion of the inner shell means extending above the outer shell means is exposed to the environment for unobstructed radiation of heat therefrom when said inner shell means is heated by a fire within said combustion zone.

15. A high efficiency combustion heater/cooker comprising:

inner shell means having thermally conductive walls;

outer shell means comprising a plurality of contiguous selectively movable shell elements surrounding the inner shell means;

each of said shell means having an upper rim and a lower rim, both said shell means defining therebetween air intake flue means open between said upper rims for admitting atmospheric air, means for closing the lower end of said outer shell means to define a combustion zone above said means for closing, said combustion zone being in communication with said air intake flue means, said inner shell means forming a wall common to both said intake flue means and said combustion zone such that air drawn downwardly into said intake flue means, due to convection of hot gases rising above a fire within said combustion zone, is preheated by transfer of heat through the walls of said inner shell means for improved combustion of fuel within said combustion zone, and said movable elements of the outer shell means being selectively positioned to provide variable draft control means for adjustably controlling the flow of intake air reaching said combustion zone through said intake flue means.

16. The combination of claim 15 in which said upper rim of said inner shell means is at an elevation relative to said upper rim of said outer shell means such that said inner shell means is substantially exposed to the environment of said heater/cooker, whereby radiation of heat from said inner shell may suffuse said environment.

17. The combination of claim 15 including container means supported at least partially within said inner shell means and defining therewith an exhaust fuel surrounding said container means for escape of combustion products rising from a fire within said combustion zone.

18. A fuel burning stove comprising:

inner shell means, outer shell means surrounding said inner shell means, said inner shell means in cooperation with said outer shell means defining therebetween air intake flue means, means closing the lower end of said outer shell means to define a combustion zone within both said shell means, said combustion zone being in communication with said air intake flue means, and said outer shell means comprising a plurality of selectively movable shell segments movable with respect to each other and being juxtaposed so as to form a substantially continuous wall surrounding said inner shell means.

19. The combination of claim 18 in which at least one of said plurality of outer shell segments is movable relative to an adjacent segment whereby a gap between adjacent edge portions of said segments may be opened temporarily for direct access to said combustion zone adjacent said means for closing the lower end of said outer shell means.

20. A method of constructing a stove including the steps of:

a. fabricating a plurality of arcuate shell segments characterized by substantially parallel opposite edges, b. juxtaposing at least two of said shell segments so as to form a first tubular shell open at both ends, c. retaining said shell segments forming said tubular shell in intimate juxtaposition for construction of said tubular shell.

d. elevating said tubular shell above a support surface whereby aperture means are provided between said support and an end of said tubular shell, e. surrounding said first tubular shell by an additional plurality of said arcuate shell segments in spaced relationship to said tubular shell to form a substantially continuous wall resting on said support surface whereby flue means are formed between said wall and said first tubular shell for downward passage of air to said aperture means, said air serving to support combustion within said tubular shell.

21. A fuel burning heater comprising:

inner shell means, outer shell means surrounding said inner shell means, said inner shell means and said outer shell means defining therebetween air intake flue means, first means for elevating the lower end of said inner shell means relative to the lower end of said outer shell to define together with an underlying supporting surface a combustion zone within said shell means, said combustion zone being in communication with said air intake flue means, said outer shell means comprising at least a pair of similar shell segments movable to selected positions relative to each other and said inner shell means;

whereby said air intake flue means may be varied in cross-sectional area for adjustably controlling the flow of air reaching said combustion zone during burning of the fuel therein.

22. The heater of claim 21 including container means and means for supporting said container means at least partially within said inner shell means and defining therewith an exhaust flue surrounding said container means for hot combustion gases rising from a fire within said combustion zone.

23. The heater of claim 21 in which at least one of said shell segments of said outer shell can be displaced laterally relative to the remainder of said shell segments whereby an opening may be provided in said outer shell for direct access to said combustion zone adjacent said lower end of said outer shell means.

24. The heater of claim 21 in which said inner shell means comprises a plurality of substantially similar arcuate inner shell segments retained in spatial relation to each other so as to form a substantially cylindrical body open at both ends.

25. The heater of claim 24 in which said inner shell means are retained in said special relation to each other by clip means in frictional engagement therewith.

26. The heater of claim 24 in which said inner shell means is substantially exposed to the environment for unobstructed radiation of heat therefrom when said inner shell means is heated by a fire within said combustion zone.

27. The heater of claim 25 in which said second means are integral with said first means.

28. The heater of claim 25 in which said second means incorporate unitary means adapted to support a utensil positioned over said combustion zone for heating said utensil and its contents.

29. The combination of claim 21 in which said plurality of said shell segments of which said outer shell means is comprised include handle means for manipulation thereof.

30. The combination of claim 21 comprising a plurality of substantially identical shell segments forming both said inner shell means and said outer shell means, and wherein said first means include a plurality of substantially identical unitary frictional engagement means, a first plurality of the last said means being clamped at the lower said rim of the inner shell means to support said inner shell means above an underlying surface closing the lower end of said outer shell means and to secure together said inner shell segments, and a second plurality of said unitary frictional engagement means being clamped on said inner shell means for supporting a cooking utensil above a fire within said combustion zone, whereby said fuel-burning heater may be constructed of a plurality of only two different artifacts.

31. The combination of claim 21 in which at least one of said plurality of shell segments of which said outer shell means is comprised, may be displaced laterally whereby an opening may be provided between adjacent edges of said segments for direct access to said combustion zone adjacent the lower end of said outer shell means.

32. A unitary frictional engagement device comprising:

first spring clamping means, said means being comprised of a pair of elements joined at one of their ends with their other ends biased toward each other;

second spring clamping means, the last said means also being comprised of a pair of elements joined at one of their ends with their outer ends biased toward each other;

one of the elements comprising each of said first and second clamping means being common;

at least one of the uncommon elements of each of said clamping means being extended to constitute support strut means whereby said clamping means may be interchangeably engaged to an upper edge of a sheet element for supporting an object on said strut means in relation to the sheet element or engaged to a lower edge of the sheet element for supporting the sheet element on said strut means away from an underlying surface.

33. A high efficiency combustion heater/cooker comprising:

inner shell means having thermally conductive walls;

outer shell means comprising a plurality of substantially similar contiguous selectively movable shell elements surrounding the inner shell means;

each of said shell means having an upper rim and a lower rim, both said shell means defining therebetween air intake flue means open between said upper rims for admitting atmospheric air, first means for elevating the lower end of said inner shell means relative to the lower end of said outer shell to define together with an underlying supporting surface a combustion zone within said shell means, said combustion zone being in communication with said air intake flue means, said inner shell means forming a wall common to both said intake flue means and said combustion zone such that air drawn downwardly into said intake flue means, due to convection of hot gases rising above a fire within said combustion zone, is preheated by transfer of heat through the walls of said inner shell means for improved combustion of fuel within said combustion zone, and said movable elements of the outer shell means being selectively positionable to provide variable draft control means for adjustably controlling the flow of intake air reaching said combustion zone through said intake flue means.

34. A fuel burning stove comprising:

inner shell means, outer shell means surrounding said inner shell means, said inner shell means in cooperation with said outer shell means defining therebetween air intake flue means, means closing the lower end of said outer shell means to define a combustion zone within both said shell means, said combustion zone being in communication with said air intake flue means, and said outer shell means comprising a plurality of selectively movable separate shell segments movable with respect to each other and juxtaposed so as to form a substantially continuous wall surrounding said inner shell means.

35. A method of constructing a high-efficiency heater including the steps of:

a. forming a plurality of truncated substantially arcuate segments each of said segments being of a circumferential span substantially greater than 180 degrees, b. juxtaposing at least two of said segments so that a first tubular shell of a 360 degree span is formed by overlapping vertical edge portions of said segments, c. retaining said juxtaposed segments in semipermanent spatial relationship to each other by thrusting frictional engagement means over said overlapping edge portions of said segments, whereby said overlapping edge portions of said segments are clamped in faying relationship, d. elevating said first tubular shell above a support surface so that the lower end of said tubular shell forms with said support surface a circumferential aperture whereby combustion may enter a combustion zone within said first tubular shell and above said support surface, and e. positioning an additional plurality of said segments to surround said first tubular shell in spaced relation thereto so as to form air intake flue means between said first tubular shell and said surrounding additional segments whereby combustion air may enter said combustion zone via said intake flue means.

36. A method of constructing a stove including the steps of:

a. fabricating a plurality of arcuate shell segments characterized by substantially parallel opposite edges, b. juxtaposing at least two of said shell segments so as to form a first tubular shell open at both ends, c. retaining said shell segments forming said tubular shell in intimate juxtaposition for construction of said tubular shell, d. elevating said tubular shell above a support surface whereby aperture means are provided between said support surface and an end of said tubular shell, e. surrounding said first tubular shell by an additional plurality of said arcuate shell segments in spaced relationship to said tubular shell to form a substantially continuous wall resting on said support surface whereby flue means are formed between said wall and said first tubular shell for downward passage of air to said aperture means, said air serving to support combustion within said tubular shell.

* * * * *